US006230405B1

(12) United States Patent
Liu et al.

(10) Patent No.: US 6,230,405 B1
(45) Date of Patent: May 15, 2001

(54) METHOD FOR MANUFACTURING A CABLE CONNECTOR ASSEMBLY

(75) Inventors: Ricky Liu; Brege Ma; Leslie Poe, all of Kun-San (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/442,108

(22) Filed: Nov. 17, 1999

(30) Foreign Application Priority Data

Jun. 11, 1999 (TW) ..... 88109746

(51) Int. Cl.[7] ..... H01R 43/00

(52) U.S. Cl. ..... 29/858; 29/857; 264/255; 264/308

(58) Field of Search ..... 29/858, 857; 264/255, 264/308

(56) References Cited

U.S. PATENT DOCUMENTS 1,601,255 * 9/1926 Marra .
2,502,860 * 4/1950 Leithiser, Jr. .
2,700,206 * 1/1955 Gilbert .
3,093,432 * 6/1963 King .
3,093,434 * 6/1963 Francis .
3,141,054 * 7/1964 Francis .
3,668,779 * 6/1972 Turner .
4,398,785 * 8/1983 Hedrick .
4,411,608 * 10/1983 Yanagaisawa .
4,574,474 * 3/1986 Langham .

* cited by examiner

*Primary Examiner*—Carl J. Arbes
(74) *Attorney, Agent, or Firm*—Wei Te Chung

(57) ABSTRACT

A method for manufacturing a cable connector assembly comprises an intercepting cable step, a connecting cable and contact step and a molding cover step. During the intercepting cable step, a tubular cable is intercepted with a given length. During the connecting cable and contact step, a body is provided to receive the cable and contacts. During the molding cover step, a second mold assembly comprising a top mold and a bottom mold is provided. The second mold assembly includes a second molding chamber for receiving the body and a end portion of the cable therein, and an elliptical passageway in communication with the second molding chamber for extension of the cable therethrough. A rib is formed in the passageway for compensating deformation of the flexible plastic pipe.

8 Claims, 7 Drawing Sheets

METHOD FOR MANUFACTURING A CABLE CONNECTOR ASSEMBLY

BACKGROUND OF THE INVENTION

1. Field of the Invention

The present invention relates to a method, and particularly to a method for manufacturing a cable connector assembly which prevents overflow of material during an insertion molding procedure.

2. Description of Prior Art

An electrical connector assembly commonly includes a cover assembled to an end of a connector and an end of a cable for facilitating manual manipulation thereof. For a miniaturized electrical connector assembly, the cover is often formed by insertion molding as disclosed in Taiwan Patent Application Nos. 80204102 and 80205362.

Referring to FIGS. 1–3, to form a cover 100 of a conventional cable connector assembly 102 is by insertion molding. A front portion of the connector 104 which extends beyond the cover 100 is received in a receiving cavity (not shown) of top and bottom molds 106. A rear portion of the connector 104 which is enclosed by the cover 100 and an end portion of a cable 108 are received in a molding chamber 110. The cable 108 extends through two semicircular recesses 112 of the top and bottom molds 106. The radius of each recess 112 is slightly smaller than that of the cable 108 for snugly retaining the cable 108 therein when the top and bottom molds 106 are coupled thereby preventing overflow of material through the recess 112 during an insertion molding procedure. The cable 108 is a pipe-type cable, namely a plurality of wires 114 is received in a flexible plastic pipe 116. Since the wires 114 are received in the pipe 116, a clearance 118 is formed between the wires 114.

However, due to the flexibility and size of the cable 108 and the shape of the recess, the pipe 116 is easily compressed out of the recesses 112 when the top and bottom molds 106 are coupled together. On the other hand, due to the size of the cable 108, the pipe 116 is also easily deformed to form an interspace 120 between the recess 112 and the cable 108. Thus, plastic material may flow out of the molding chamber 110 during the insertion molding procedure.

SUMMARY OF THE INVENTION

Accordingly, an object of the present invention is to provide a method for manufacturing a cable connector assembly, which can prevent molding material from overflowing during an insertion molding procedure.

In the preferred embodiment of the present invention, a method for manufacturing a cable connector assembly comprises an intercepting cable step, a connecting cable and contact step, and a molding cover step. During the intercepting cable step, a tubular cable is provided with an appropriate length. During the connecting cable and contact step, a body is provided to receive the cable and contacts. During the molding cover step, a second mold assembly comprising a top mold and a bottom mold is provided. The second mold assembly includes a second molding chamber for receiving the body and an end portion of the cable therein, and an elliptical passageway in communication with the second molding chamber for extension of the cable therethrough. A rib is formed in the passageway for compensating deformation of the flexible plastic pipe.

BRIEF DESCRIPTION OF THE DRAWINGS

Other objects and advantages of the present invention will be understood from the following description of a cable connector assembly according to a preferred embodiment of the present invention shown in the accompanying drawings, in which.

DETAILED DESCRIPTION OF THE PREFERRED EMBODIMENT

Figure 1:
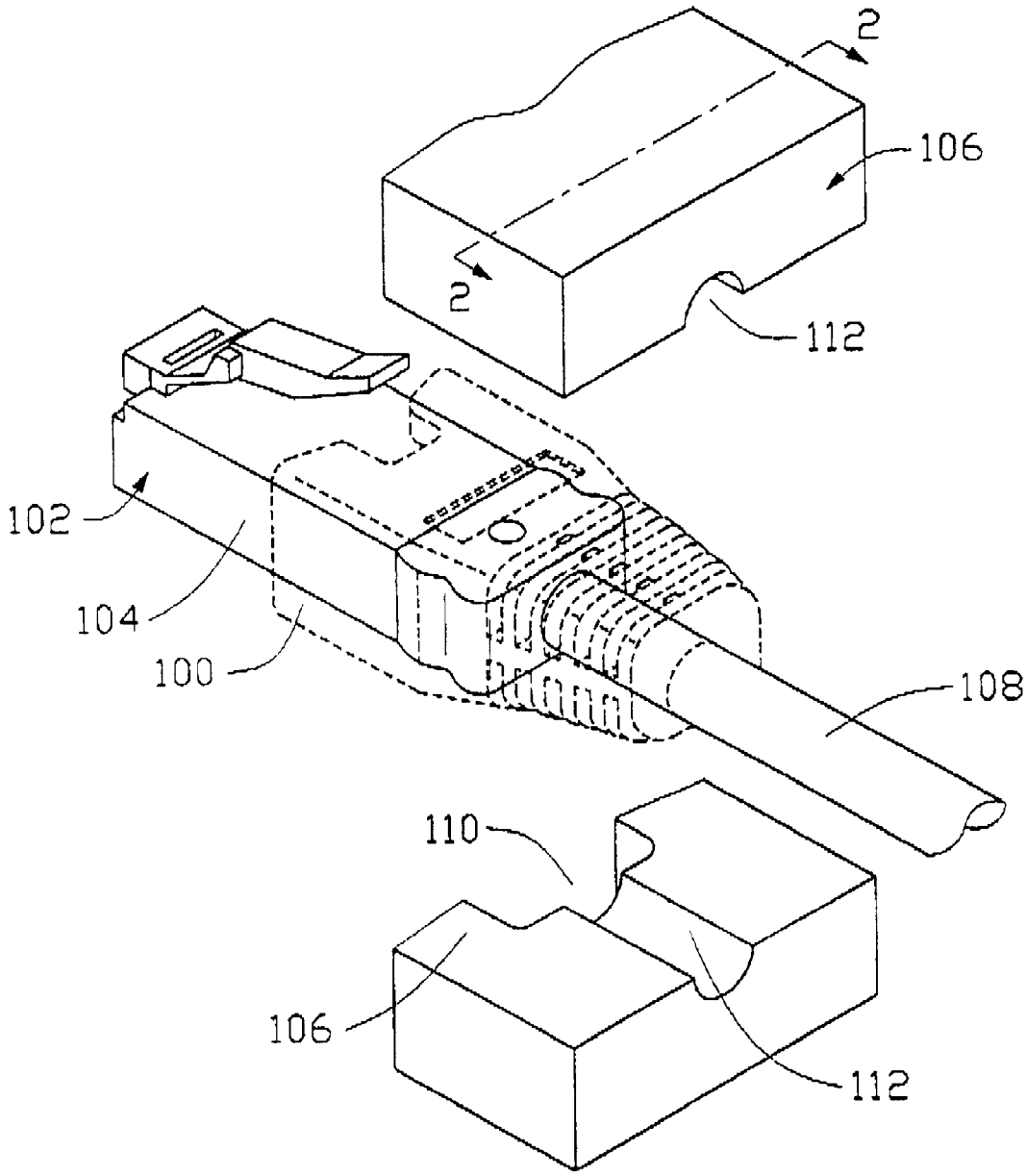
FIG. 1 (PRIOR ART)
FIG. 1 is a perspective view of a cable connector assembly and an exploded view of a mold for a step of a conventional method for manufacture.
Figure 2:
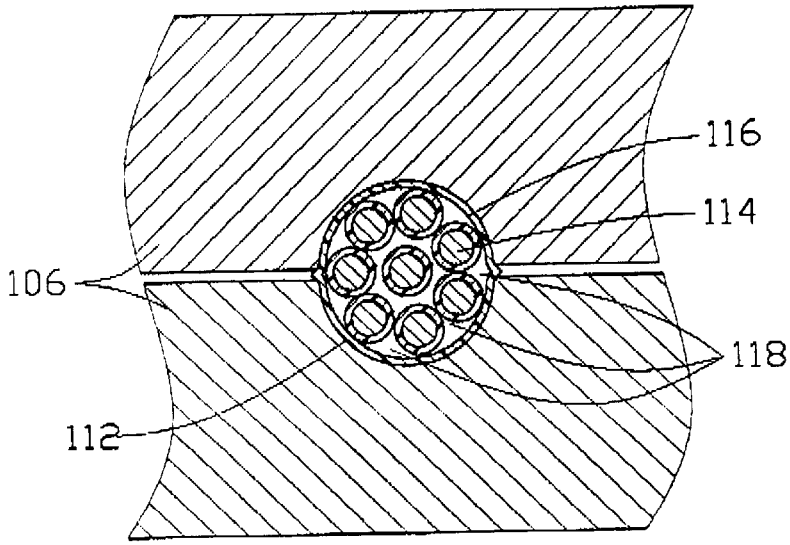
FIG. 2 (PRIOR ART)
FIG. 2 is a cross sectional view of the cable connector assembly and the mold taken along line 2—2 of FIG. 1.
Figure 3:
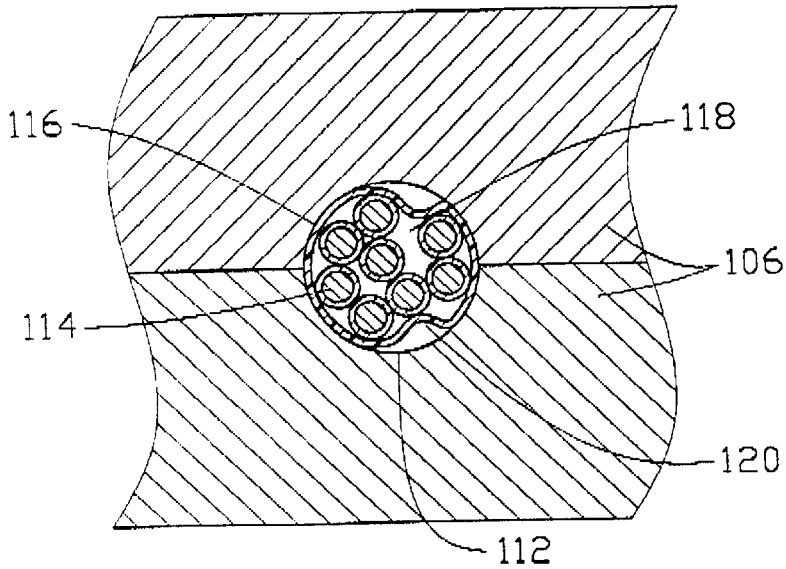
FIG. 3 (PRIOR ART)
FIG. 3 is a view similar to FIG. 2 showing a different assembled result.
Figure 4:
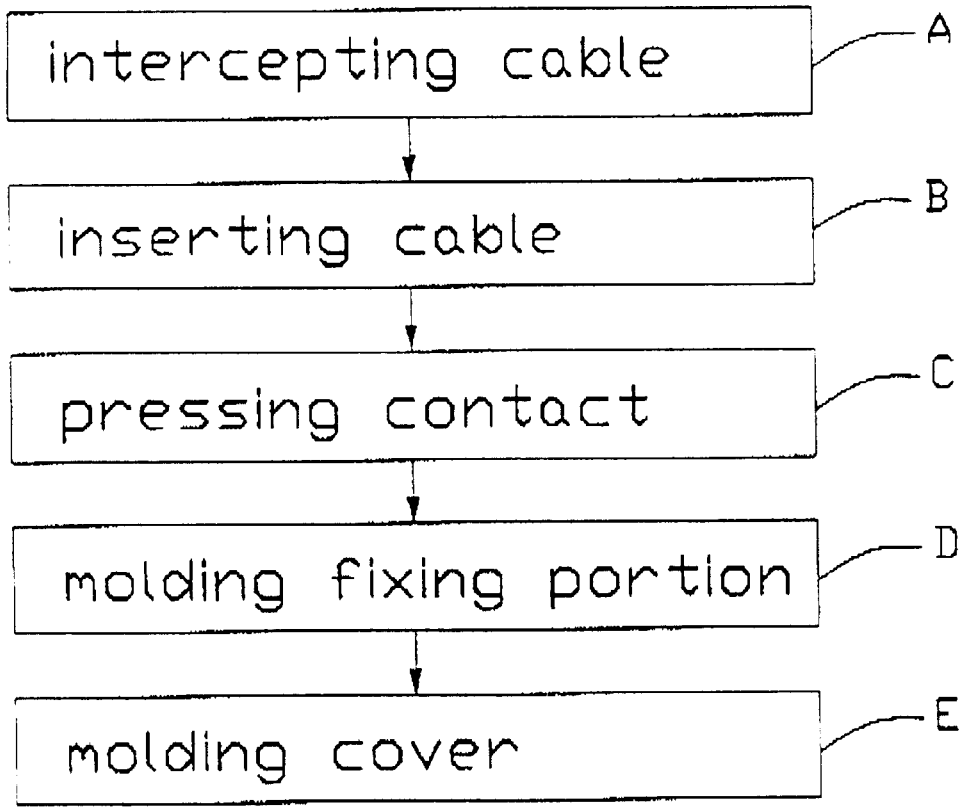
FIG. 4 is a flow chart of a method for manufacturing a cable connector assembly embodying the concepts of the present invention.
Figure 5:
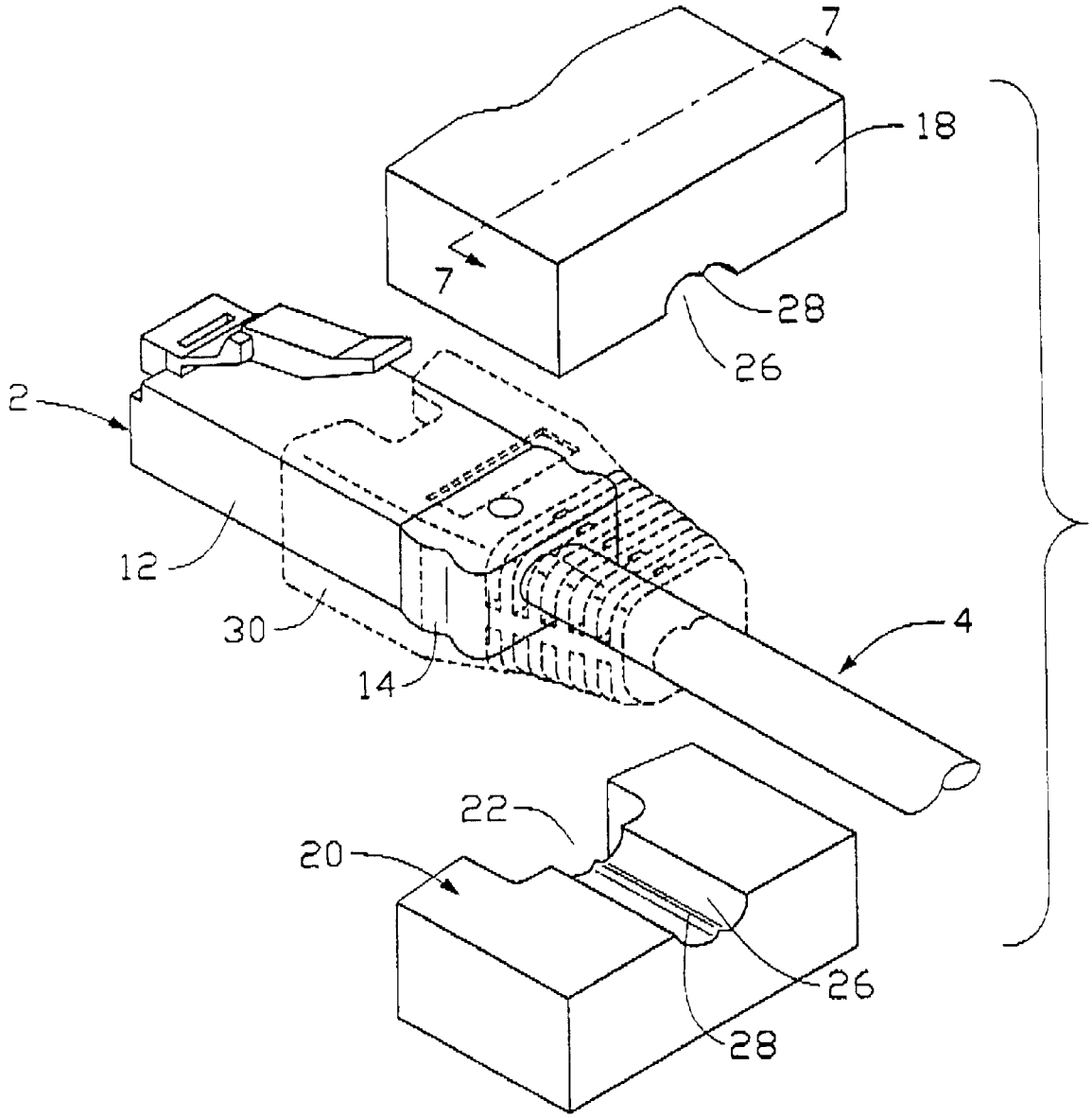
FIG. 5 is a perspective view of a cable connector assembly and an exploded view of a mold assembly for a step of the method of the present invention.
Figure 6:
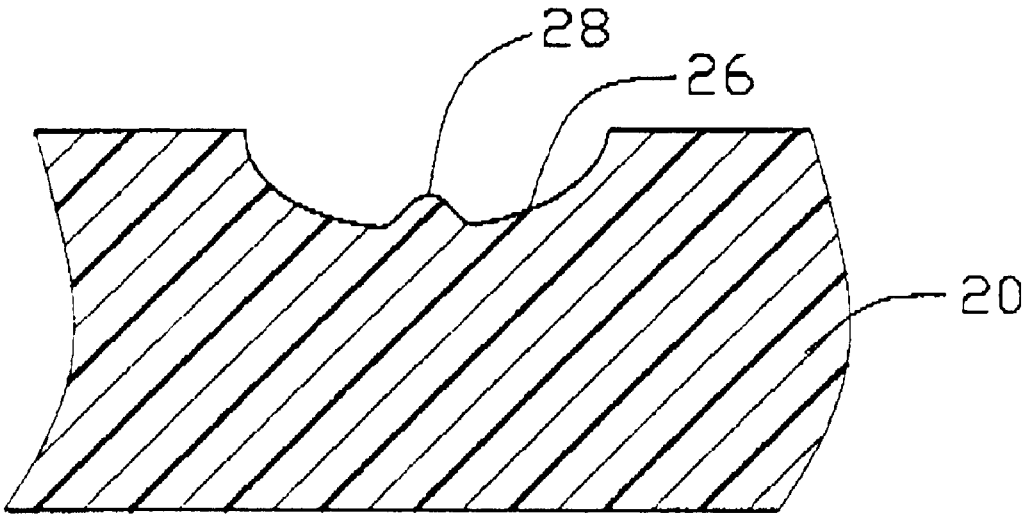
FIG. 6 is a partial, cross sectional view of a bottom mold of the present invention.
Figure 7:
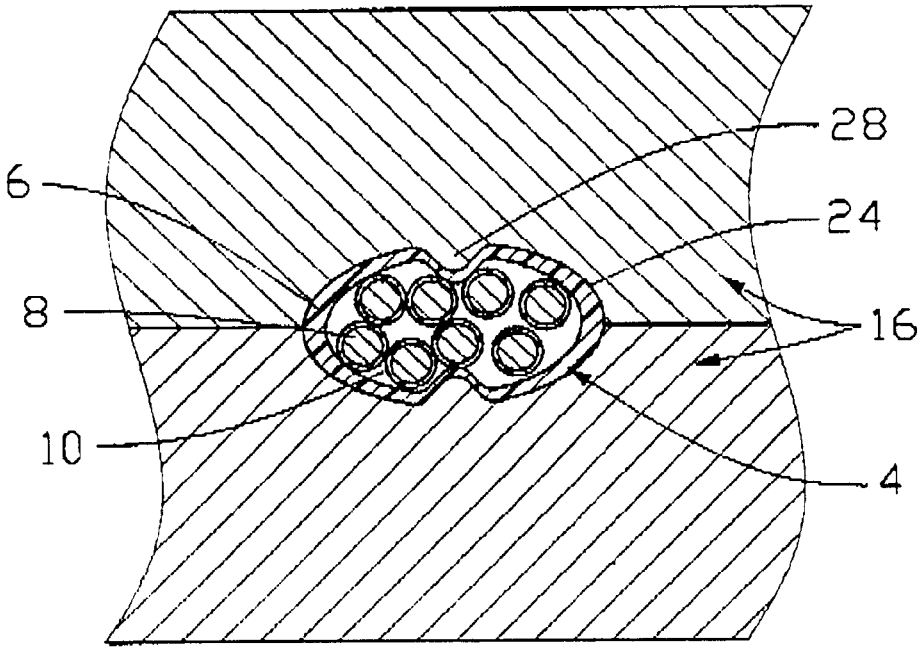
FIG. 7 is a cross-sectional view of the cable connector assembly and the mold assembly taken along line 7—7 of FIG. 5.

Referring to FIGS. 4–7, a method for manufacturing a cable connector assembly 2 in accordance with the present invention comprises the following steps: intercepting cable, inserting cable, pressing contact, molding fixing portion, and molding cover.

In the intercepting cable step A, a tubular cable 4 which comprises a flexible plastic pipe 6 and a plurality of wires 8 received in the pipe 6 with interspace 10 therein is intercepted with a given length in accordance with design requirements.

In the inserting cable step B, a body 12 which forms a plurality of first slots (not shown) for insertion of the wires 8 of the cable 4 and a plurality of second slots (not shown) perpendicular to and in communication with the first slots is provided. An end portion of the pipe 6 of the cable 4 is stripped to expose a suitable length of the wires 8. The wires 8 are then inserted into the corresponding first slots of the body 12.

In the pressing contacts step C, a plurality of IDC contacts (not shown) is provided and inserted into the corresponding second slots of the body 12 to electrically connect with the corresponding wires 8 of the cable 4.

In the molding fixing portion step D, the body 12 assembled with the contacts and the cable 4 is disposed in a first molding chamber of a first mold assembly (not shown) with a suitable length of the cable 4 positioned in the chamber. Plastic is then injected into the first molding chamber, and a fixing portion 14 is molded around the cable 4 and the body 12 thereby securing the cable 4 to the body 12.

In the molding cover step E, a second mold assembly 16 including a top mold 18 and a bottom mold 20 is provided. The second mold assembly 16 includes a second molding chamber 22 (partially shown) for receiving the body 12, the fixing portion 14 and the end portion of the cable 4 therein, and an elliptical passageway 24 in communication with the second molding chamber 22 for extension of the cable 4 therethrough. The elliptical passageway 24 is formed by a pair of semi-elliptical recesses 26 respectively formed in the top and bottom molds 18, 20. Since the recess 26 is semi-elliptical, the cable 4 is easily received in the passageway 24 without the pipe 6 extending out of the passageway 24 when the top and bottom molds 18, 20 are coupled together. A rib 28 projects from each recess 26. When the cable 4 is received in the passageways 24, the flexible plastic pipe 6 is deformed to compensate for the interspace 10 therein due to the projecting ribs 28. Thus, the body 12 is disposed in the second molding chamber 22 with the cable 4 extending through the passageway 24, plastic material is injected into the second molding chamber 22, and the cover 30 is molded without any overflow of plastic material. Since the cable 4 abuts against the ribs 28 of the second mold assembly 16, the cable 4 received in the second molding chamber 22 proximate the ribs 28 is deformed to have notches (not labeled). Thus, the cover 30 forms protrusions corresponding to the notches of the ribs 28.

Figure 8:
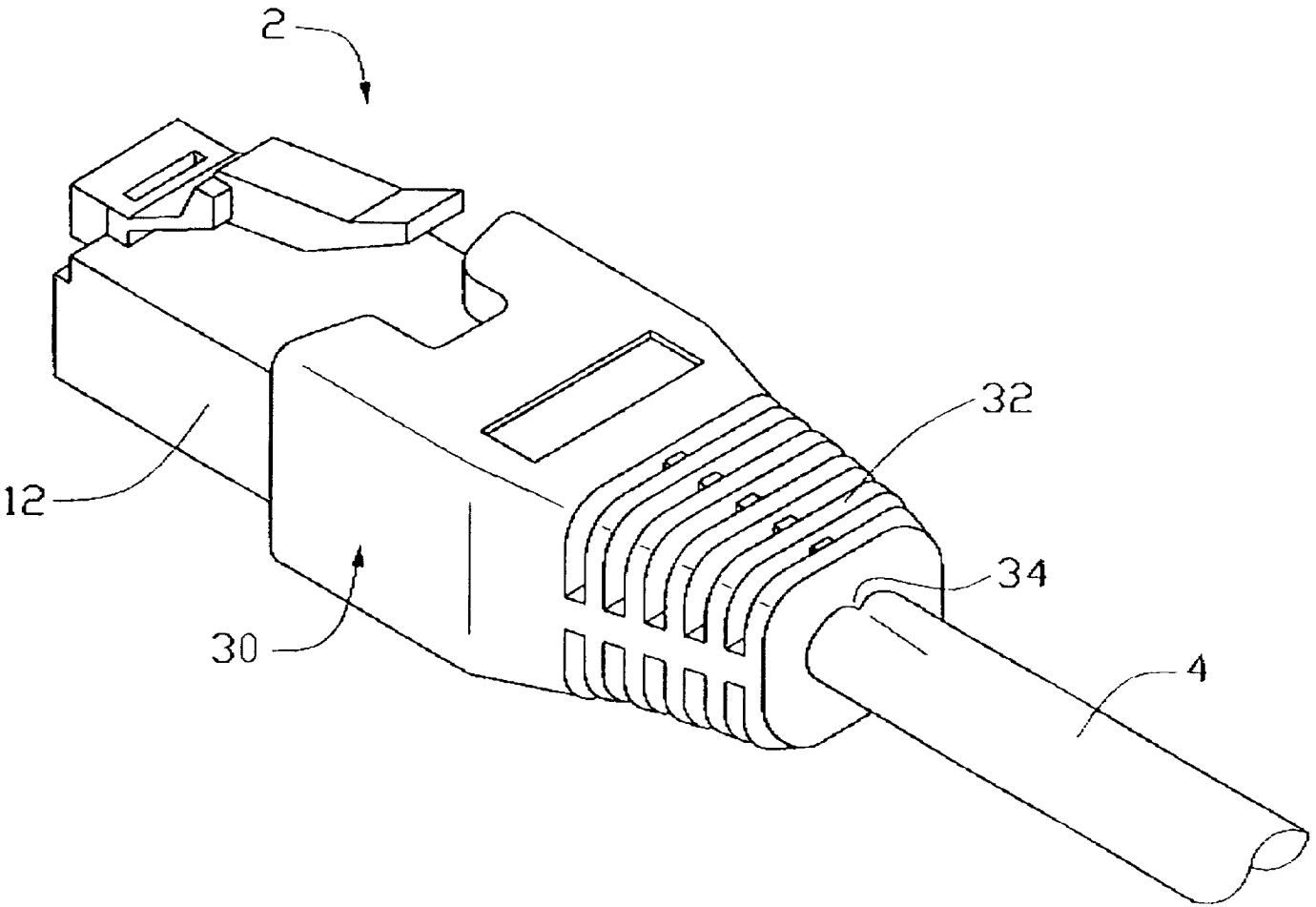
FIG. 8 is a perspective view of the cable connector assembly of the present invention.

Referring now to FIG. 8, the cable connector assembly 2 made in accordance with the foregoing steps includes the body 12, the cable 4 and the cover 30. The body 12 includes a plurality of contacts received therein for electrically connecting with the wires 8. The fixing portion 14 is formed at an end portion of the body 12 for securing the cable 4. The cable 4 is tubular The cover 30 includes a strain relief portion 32 enclosing the cable 4. A pair of protrusions 34 projects from an inner surface of the strain relief portion 32 for engaging with the notches of the cable 4.

It will be understood that the present invention may be embodied in other specific forms without departing from the spirit of the central characteristics thereof. The present examples and embodiments, therefore, are to be considered in all respects as illustrative and not restrictive, and the invention is not to be limited to the details given herein.

What is claimed is:

1. A method for manufacturing a cable connector assembly, comprising the steps of:

connecting an end portion of a cable with a plurality of contacts within a body of the cable connector assembly, the cable comprising a plurality of wires and a flexible plastic pipe enclosing the wires;

molding a fixing portion around a rear end of the body for securing the cable with the body;

compensating an interspace existed between the wires of the cable by positioning a portion adjacent to and connecting with the end portion of the cable in an elliptical passageway between coupled top and bottom molds of a mold assembly and by inwardly wedging a rib formed in the passageway against the flexible plastic pipe and further into the cable thereby forming thereabouts a pair of notches in an outer surface of the cable; and molding a cover by the mold assembly forming a strain relief portion around a part of the cable and a pair of protrusions projecting from an inner surface of the strain relief portion for engaging with the notches of the cable.

2. The method for manufacturing a cable connector assembly as described in claim 1, wherein the step of molding the cover comprises forming the elliptical passageway of the mold assembly of by a pair of semi-elliptical recesses respectively formed in the top and bottom molds.

3. The method for manufacturing a cable connector assembly as described in claim 1, wherein the step of the molding the cover comprises projecting the rib of the mold assembly from one of the recesses of the top and bottom molds.

4. The method for manufacturing a cable connector assembly as described in claim 1, wherein the step of connecting comprises inserting the cable and pressing the contacts.

5. The method for manufacturing a cable connector assembly as described in claim 4, wherein the step of inserting the cable comprises forming the body with a plurality of first slots for insertion of the wires of the cable, and a plurality of second slots perpendicular to and in communication with the first slots.

6. The method for manufacturing a cable connector assembly as described in claim 5, wherein the step of pressing the contacts comprises inserting the contacts into the corresponding second slots of the body to electrically connect with the corresponding wires of the cable.

7. The method for manufacturing a cable connector assembly as described in claim 1, further including a step of intercepting the cable with a given length before the step of connecting.

8. A method for making a cable assembly, comprising the steps of:

providing a cable having a plurality of wires retained by a pipe, each wire including a conductor coated with an insulative layer, said cable further defining a connecting section in which said conductive wires are exposed;

providing a cable end connector including a housing which a plurality of terminals assembled therein;

connecting ends of said conductors to said terminals;

compensating interspace between said conductive wires of said connecting section;

molding a fixing portion around a rear end of said housing to flexedly attach the conductive wires of said connecting section to the housing; and molding a cover over the connector with the conductive wires of said connecting section encapsulated therein.

* * * * *